United States Patent [19]

Senn et al.

[11] 4,436,123

[45] Mar. 13, 1984

[54] DEVICE FOR STORING FILAMENTARY MATERIAL FOR USE ON A LOOM

[75] Inventors: Georg Senn; Walter Koch, both of Rüti, Switzerland

[73] Assignee: Ruti Machinery Works Ltd., Ruti, Switzerland

[21] Appl. No.: 314,736

[22] Filed: Oct. 23, 1981

[30] Foreign Application Priority Data

Oct. 31, 1980 [CH] Switzerland ..... 8108/80
Sep. 7, 1981 [CH] Switzerland ..... 5739/81

[51] Int. Cl.[3] ..... D03D 47/34
[52] U.S. Cl. ..... 139/452; 28/257; 226/119; 242/47.01
[58] Field of Search ..... 139/452, 435, 450; 226/118, 119; 28/257; 242/47.01

[56] References Cited

U.S. PATENT DOCUMENTS 3,672,819 6/1972 Katsuyama et al. ..... 28/257 X
3,902,644 9/1975 Bous ..... 226/118 X
4,002,190 1/1977 Sevcik et al. ..... 139/452
4,089,720 5/1978 Haley ..... 28/257 X
4,167,954 9/1979 Karcher ..... 139/452

FOREIGN PATENT DOCUMENTS 2215003 8/1980 Fed. Rep. of Germany .
3014776 11/1980 Fed. Rep. of Germany .
46-36509 10/1971 Japan ..... 139/452
49-26097 7/1974 Japan ..... 139/452

*Primary Examiner*—James Kee Chi
*Attorney, Agent, or Firm*—Donald D. Denton

[57] ABSTRACT

The device for the storing of filamentary material contains a thread storage and a feed nozzle associated with it, the thread storage having a thread carrier which rotates past the feed nozzle and the feed nozzle being arranged fixed in position and rigid; and the depositing of the thread ($S_1$, $S_2$, $S_3$) on the thread carrier takes place in the form of thread packages ($P_1$, $P_2$, $P_3$) which consist of partially superimposed turns so that the length of the thread package ($P_1$, $P_2$, $P_3$) and thus of the entire storage can be kept small, so that the storage is particularly suitable for looms, especially when using so-called mixers. The thread carrier is preferably covered by a small plate at the point of the formation of the thread packages, and the thread packages are deposited in the space between the thread carrier and the plate. In this way the thread packages are fixed on the thread carrier and the individual turns cannot entangle or move relative to each other, so that the device is also excellent for heavy yarn.

12 Claims, 5 Drawing Figures

FIG. 4
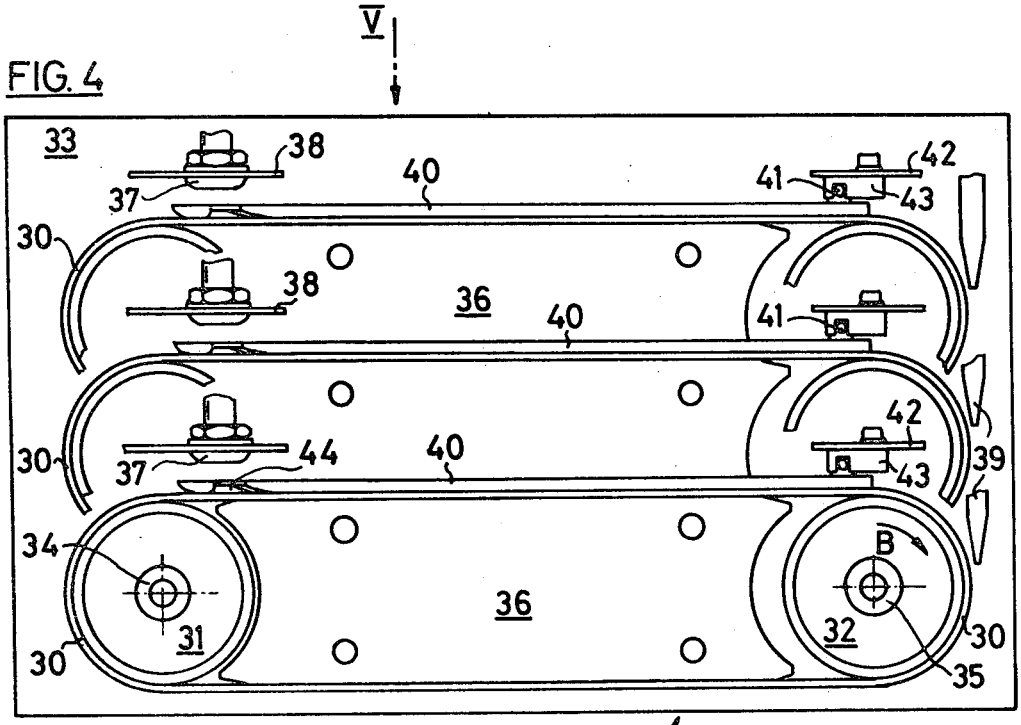
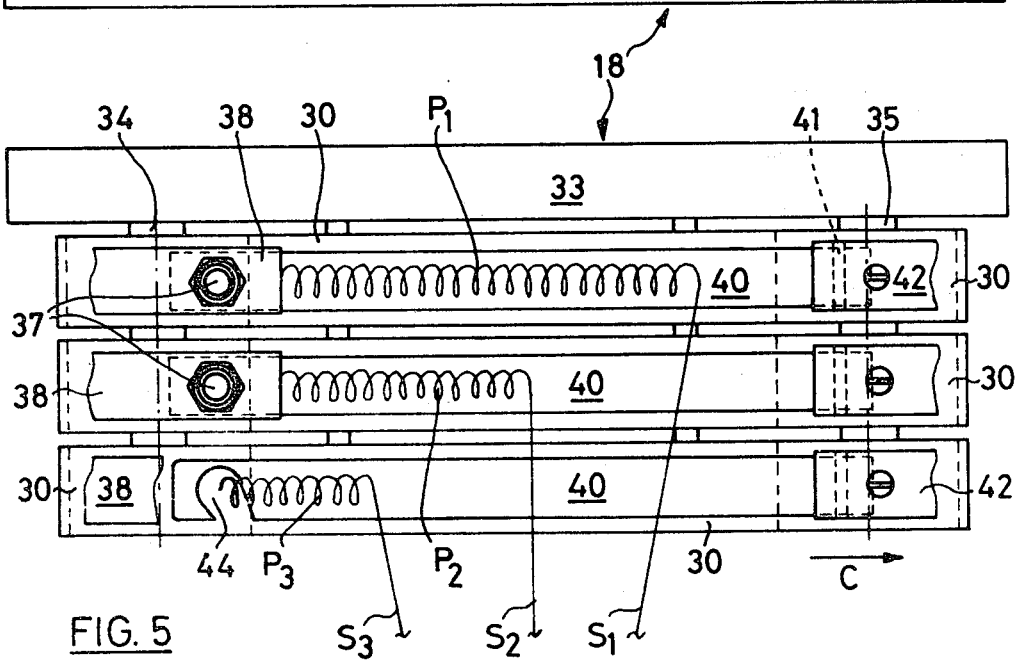
FIG. 5

DEVICE FOR STORING FILAMENTARY MATERIAL FOR USE ON A LOOM

BACKGROUND OF THE INVENTION

The present invention relates to a device for the storing of filamentary material, having a thread storage and a feed nozzle associated with it, the thread storage having a thread carrier which rotates past the feed nozzle and temporarily holds the thread fed to it, and the use of the device on a loom.

In one known device of this type, the feed nozzle is moved transverse to the direction of rotation of the thread carrier so that the thread is laid in traversing manner in the form of loops lying one behind the other and free of overlap. If a large length of thread, for instance the filling thread for a wide loom, is to be stored with this device, then either the individual loops of thread must be very wide in the direction of movement of the feed nozzle or the capacity of the thread storage must be sufficient for a very large number of thread loops. The former requires, in addition to a large operating stroke of the feed nozzle, also a relatively wide thread storage, while the latter requires a very long thread storage. In addition to this, the moving of the feed nozzle requires a separate drive, as a result of which this device is complicated in construction as compared with known mechanical and pnuematic storage devices and is accordingly expensive.

For this reason, such storage devices have up to now not been used on looms, although the principle of a thread carrier which is moved past a feed nozzle and has a thread lay-on surface has been known for a long time from the texturing or crimping art.

The closest prior art known to the applicants is in German Pat. No. 22 15 003.

SUMMARY OF THE INVENTION

By this invention, a device of the aforementioned type is to be so improved and developed that it can be used on looms. The device should be of simple construction and have the smallest possible dimensions.

This object is obtained, in accordance with this invention, in the manner that the feed nozzle is arranged rigidly fixed in position, and the depositing of the thread on the thread carrier takes place in the form of thread packages consisting of partially superimposing turns.

By the rigid arrangement of the feed nozzle, a substantial simplification in the construction of the arrangement is obtained. Due to the superimposing of the turns, the thread lay-on surface can be kept small; the thread packages are only a few millimeters wide and about 100 to 200 millimeters long. Although on basis of a prejudice held by the man skilled in the art, it was to be expected that the different adherence conditions between the turns and the thread lay-on surface resulting from the superimposing of the turns would make the device incapable of operation, practical testing has shown exceptionally good operation of the device.

In one preferred embodiment of the device of the invention, the thread carrier is covered by a cover member at the point of the formation of the thread packages and the depositing of the thread packages is effected into the space between thread carrier and cover member.

The thread package is fixed in position and protected from disturbing influences by the cover member during the phase of the building-up of the thread and during its withdrawal and in particular there can be no throwing of individual turns of the thread package over each other. Such a throwing-over could not be entirely excluded up to now in cases in which certain external influences existed, for example vibrations, particularly in the case of heavy yarns.

The invention furthermore relates to a use of the said device on a loom which is fed filling threads drawn from a plurality of supply bobbins and into which the different filling threads are alternately inserted, the alternations of the different filling threads taking place in a constant rhythm and in each case one filling thread from one supply bobbin following one from another supply bobbin.

This use is characterized by the fact that a separate feed nozzle is provided for each of the filling threads and that a common drive is provided for the thread carriers associated with the feed nozzles.

In this use as so-called filling-thread mixer, the device of the invention is superior, for example, on jet looms, to the known filling-thread mixers. Up to now mixers constructed either from a plurality of mechanical means with winding drums and rotating winding members or of a plurality of pneumatic units have been used, they being in each case of complicated construction and requiring a large amount of space. Now, by the use of the device of the invention, both the expense and the space required are decisively decreased.

BRIEF DESCRIPTION OF THE DRAWINGS

The invention will be explained in further detail below with reference to illustrative embodiments shown in the drawings, in which:

FIG. 4 is a view of a second embodiment of the thread carrier seen from the loom side; and FIG. 5 is a view in the direction of the arrow V in FIG. 4.

DESCRIPTION OF PREFERRED EMBODIMENTS

Figure 1:
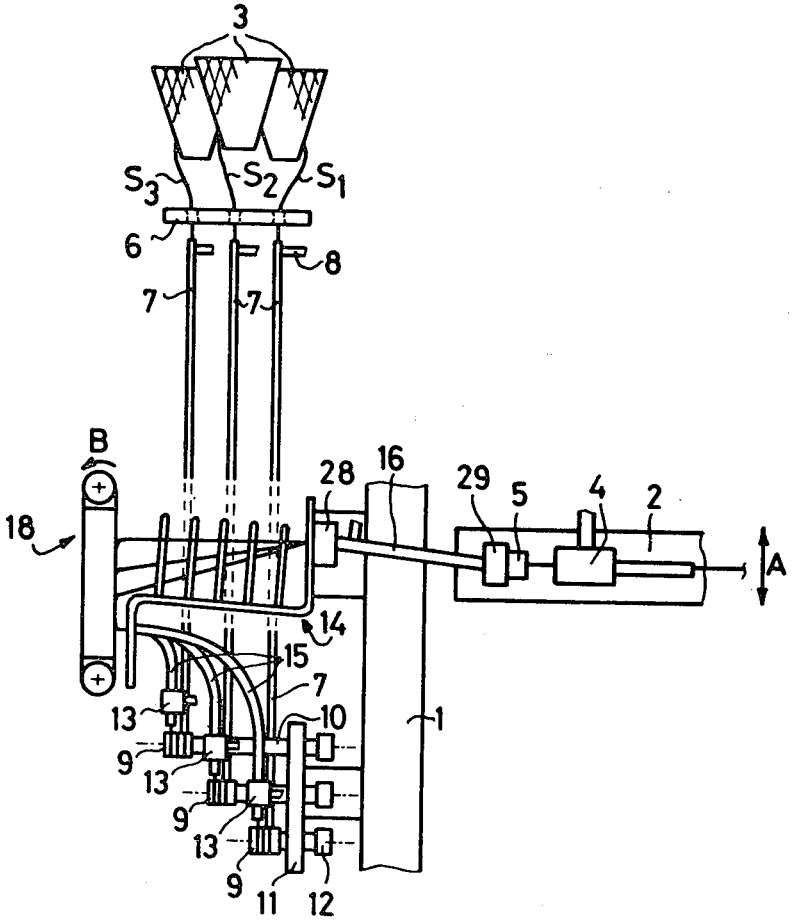
FIG. 1 is a diagrammatic plan view of a filling-thread mixer in accordance with the invention, attached to the side of an air jet loom.

In FIG. 1, the left side wall of an air-jet loom is designated 1 and the batten which is moved back and forth in the direction of the double-ended arrow A is designated 2. On the side wall 1 there is fastened the device of this invention for measuring and storing the lengths of filling thread to be inserted, this device comprising, in accordance with the drawing, a so-called triple mixer. This means that the loom is fed filling threads $S_1$, $S_2$, $S_3$, withdrawn from three supply bobbins designated 3, and that the different filling threads are inserted alternately. The alternation of the different filling threads takes place in a constant rhythm and three filling threads $S_1$, $S_2$, and $S_3$ are inserted each time in three successive weaving cycles. The insertion of the filling thread is effected by a jet unit 4, mounted on the batten 2 and consisting of three nozzles. Such a jet unit is described in West German Unexamined Application for U.S. Pat. No. OS 30 14 776, the disclosure of which is incorporated in this application by way of reference. In front of each nozzle of the jet unit 4, as seen in the direction of the insertion of the filling thread, i.e. to the left of the jet unit 4 in the figure, a controlled thread gripper is arranged on the batten 2.

The filling threads $S_1$, $S_2$ and $S_3$ which are withdrawn from the supply bobbins 3 pass through individual thread guide eyes 6 into separate first guide tubes 7. Each of the first guide tubes 7 has a compressed air connection 8 and they extend to the circumference of measurement rolls 9. The latter are rotatably mounted by their drive shaft 10 in a common plate 11 connected with the side wall 1. At the other end of each drive shaft 10 there is fastened a pulley 12. By means of a common belt (not shown), the three pulleys 12, and thus the measurement rollers 9, are driven continuously in the same direction so that all three filling threads $S_1$, $S_2$ and $S_3$ are withdrawn continuously from the supply bobbins 3. Since each filling thread is inserted only during each third weaving cycle, the measurement rollers 9 are driven only at one-third of the speed which would be necessary if the filling thread were withdrawn from only a single storage bobbin.

By a differential drive of the different measurement rollers 9 the sequence of the insertion of the filling threads can be varied. Thus, for example, the filling-thread sequence $S_1$, $S_2$, $S_3$, $S_2$ can be obtained if the measurement rollers 9 for $S_1$ and $S_3$ are each driven with one-quarter of the speed required in the case of only one filling thread and the measurement roller 9 for $S_2$ is driven with one-half of the speed.

The ends of the first thread guide tubes 7 lie just below their associated measurement rollers 9 and each filling thread $S_1$, $S_2$ and $S_3$ wraps around its measurement roller 9 in a plurality of spaced turns, for instance three as shown in the drawing.

Above each measurement roller 9 there is arranged a conveyor nozzle 13 which is acted on by compressed air and to which there is connected a thread guide member 15, for instance a curved tube or a hose, which leads to a mounting plate 14. The mounting plate 14, which is shown in detail in FIG. 3, consists, as shown in the drawing, of three surfaces: In the first surface 14*a*, three first thread guide eyes M are arranged vertically above one another, the three thread guide members 15 discharging into said eyes; on the second surface 14*b*, which is parallel to the first surface 14*a*, there are two thread guide eyes N from which there branch off three second thread guide tubes 16 which lead to the thread grippers 5 on the batten 2; the third surface 14*c*, which is approximately perpendicular to the surfaces 14*a* and 14*b*, bears at the level between the thread guide eyes M and N respectively and below the lowermost thread guide eyes M and N respectively, three grids formed of bars 17. The last grid is required for heavy yarns.

Figure 2:
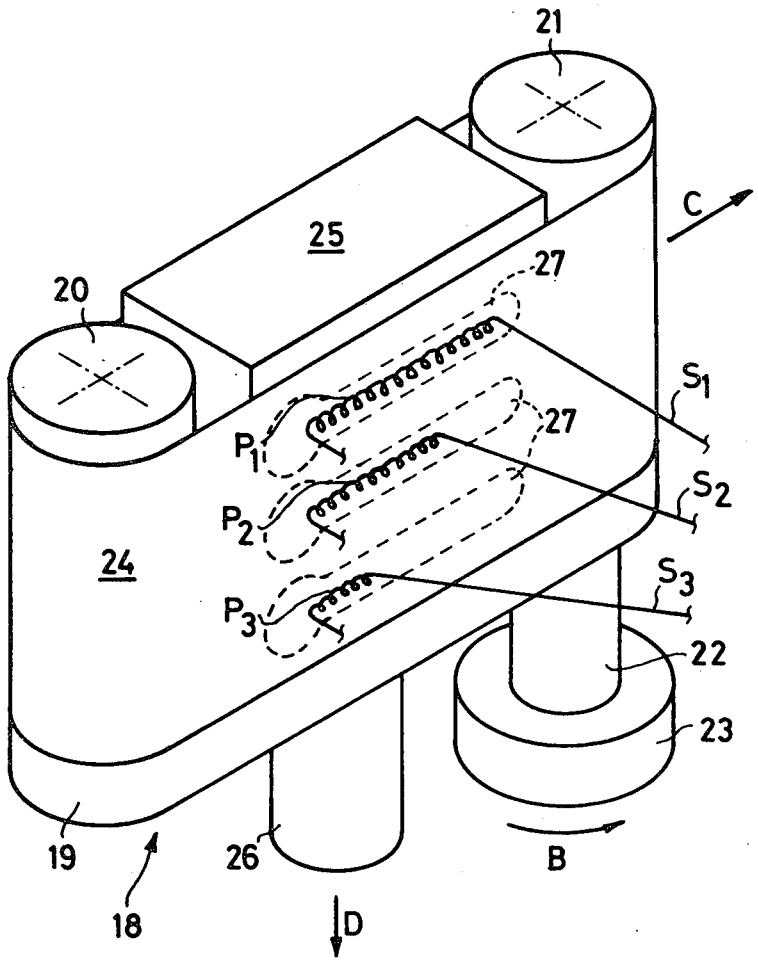
FIG. 2 is a view in perspective of a first embodiment of the thread carrier of the mixer of FIG. 1 seen from the side of the loom.

Spaced from the first surface 14*a* there is arranged a storage device 18, a first embodiment of which is shown by way of example in FIG. 2. The storage device 18 consisted, in accordance with the illustration, of a base plate 19 which is connected to the side wall 1 of the loom and on which there are rotatably mounted two vertically arranged rollers 20 and 21. The roller 20 is freely rotatable; the roller 21 is connected via a stub shaft 22 with a pulley 23 which can be driven in the direction of the arrow B by a belt (not shown) and form a common drive means. Over the two rollers 20 and 21 there is conducted a thread carrier 24 in the form of an endless belt, the outside of which serves as thread lay-on surface. In the operation of the loom, with the roller 21 rotating, the thread lay-on surface which faces the mounting plate 14 moves, in the direction of the arrow C, past the first thread guide eyes M in the first surface 14*a*.

In the space within the storage device 18, which is enclosed by the two rollers 20 and 21 and the thread carrier 24, a suction device or cleaning means 25 is inserted. It has a box shape and is provided at its lower surface, mounted on the base plate 19, with a connection 26 which extends downward from the base plate 19 and to which there is connected a hose (not shown) via which air is drawn off in the direction indicated by the arrow D. The suction line is always in operation when the main switch of the loom is on. On its surface facing the mounting plate 14 the box-shaped suction device 25 has two key-slot-shaped openings 27 extending in the direction of the arrow C.

The thread carrier 24 lies, on its front surface having the openings 27 and on its rear surface which is parallel to the front surface, against the suction device 25 and is pervious to air. It consists of a textile or textile-like material, for instance of a filter fabric, or of a perforated metal strip. Thus upon the drawing off of the air in the direction indicated by the arrow D, a stream of suction air is produced through the thread carrier 24 in the region of each of the openings 27. The regions passing over the openings 27 therefore form in each case a thread lay-on track on which a thread can be held by suction. Due to the action of the suction, the thread lay-on surface of the thread carrier 24 need not be of special development.

Of course the thread lay-on surface could also be provided with a special adherence layer for instance of bristles or of a plush or velvet-like material, in which case the additional effect of the suction air could possibly be dispensed with.

In the illustrative embodiment shown, the suction air acts furthermore as cleaning agent for the thread carrier 24. If the effect of the suction air is not sufficient to clean the thread carrier 24, additional suction or blast can be provided on the rear surface of the suction device 25, or for instance a stripping rail for the accumulated dust or a cleaning comb for the thread carrier 24 or other means can for instance be provided there.

The filling threads $S_1$, $S_2$ and $S_3$ extend from each first thread guide eye M in the first surface 14*a* of the mounting plate 14 to the associated second thread guide eye N in the second surface 14*b* and thus to its second thread guide tube 16. The grids formed by the separating bars 17 prevent mutual contact here and thus entangling of the individual filling threads. Since the mounting plate 14 is fixed in position and the batten 2 carries out an oscillating movement during the operation of the loom, the second thread guide tubes 16 which connect the mounting plate 14 with the thread grippers 5 are pivotally mounted at their ends in heads 28 and 29 respectively. In accordance with the drawing, the second thread guide tubes 16 are provided, directly behind the head 28, in each case with a pressure-air connection for the threading of the filling threads.

When the loom is in operation, the filling threads $S_1$, $S_2$ and $S_3$ from the first thread guide eyes M in the first surface 14*a* of the mounting plate 14 are blown onto the thread lay-on surface of the thread carrier 24 which is moved in the direction indicated by the arrow C. The said thread guide eyes M therefore in each case lie in the level of one of the openings 27.

Each opening 27 is circularly widened at the point of impingement of its filling thread $S_1$, $S_2$ or $S_3$ so as to absorb the blowout air from the first thread guide eyes M as completely as possible. The guidance of the air within the suction device 25 is so designed that the three key-slot-shaped openings 27, each of which forms an air inlet channel, have the same through-put of air.

As a result of the fixed position of the first thread guide eyes M, thread packages $P_1$, $P_2$ and $P_3$ are formed on the thread carrier 24 in the region of the openings 27, which packages consist of partially overlapping turns. Each thread package $P_1$, $P_2$ or $P_3$ must contain, at the beginning of each third weaving cycle, the length of thread which is necessary for one filling thread insertion.

Figure 3:
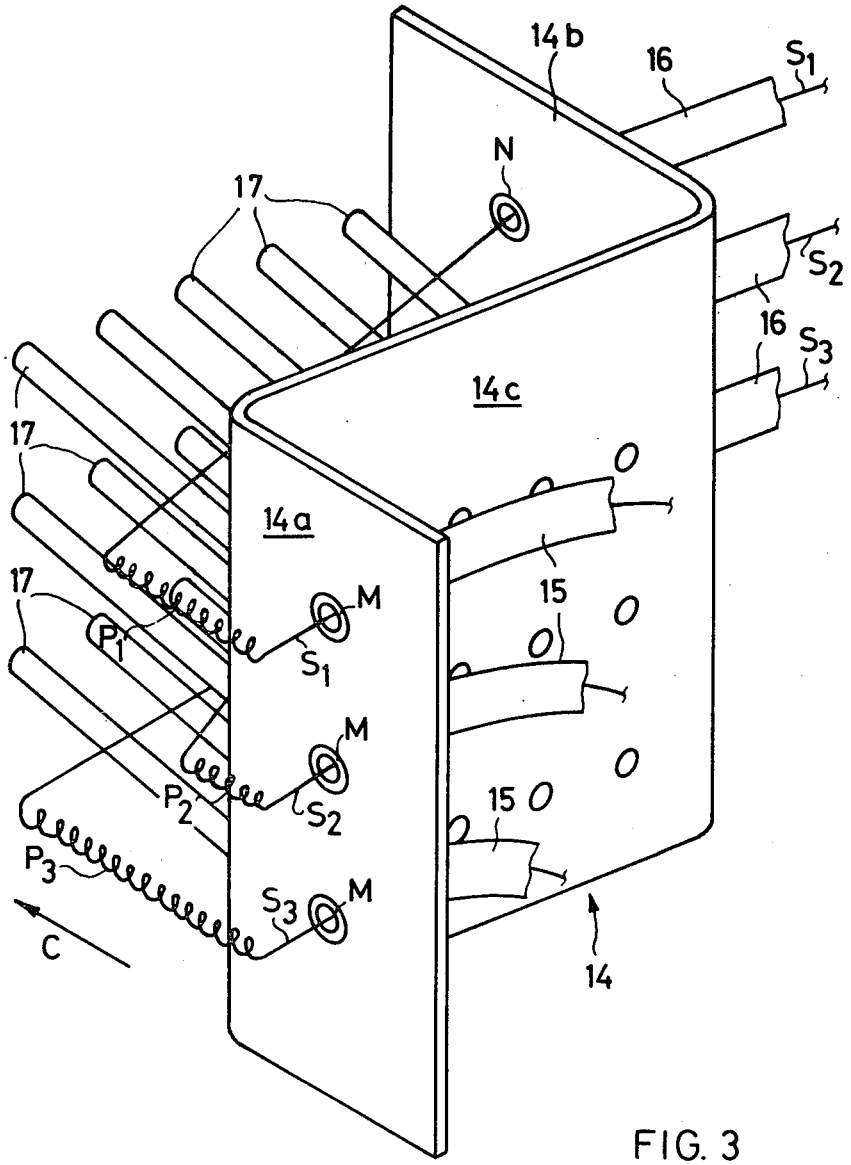
FIG. 3 is a view in perspective of a detail of the mixer of FIG. 1 seen in the direction of the filling thread, the thread carrier having been omitted.

In the embodiment shown by way of example, the filling threads $S_1$, $S_2$ and $S_3$ are introduced in the sequence of their subscripts, i.e. first the filling thread $S_1$, then the filling thread $S_2$, and then the filling thread $S_3$. In FIGS. 1, 2, and 5, the thread package $P_1$ has just reached the necessary size and the filling thread $S_1$ can be inserted. The thread package $P_2$ is only two-thirds of the required size and the thread package $P_3$ only one-third. In the showing of FIG. 3, the filling thread $S_3$ is directly before insertion. Accordingly, the thread package $P_3$ has reached its full size, the thread package $P_1$ has two-thirds of its full size, and the thread package $P_2$ one-third of this size.

FIGS. 4 and 5 show a second embodiment of the storage device 18. As shown in the drawing, it consists of three thread carriers 30 in the form of an endless belt, each of which is conducted over two rollers 31 and 32. The rollers 31 and 32 are arranged on shafts 34 and 35 mounted in a common mounting plate 33. One of the rollers 31, 32 of each pair of rollers is driven in the direction of the arrow B in the region of the storage device. Between the two rollers 31, 32 of each pair of rollers there is provided an approximately prism-shaped base body 36 which is bolted to the mounting plate 33, which in its turn is connected to the adjacent side wall 1 (FIG. 1) of the loom.

The base bodies 36 consist of wood or of a woodlike plastic or some other suitable plastic and are so dimensioned that the upper and lower courses of each belt 30 slide along the corresponding side surfaces of its base body 36 or, in other words, are supported from the inside by the base body 36. The outside of the belts 30 serves as thread lay-on surface and is plastic-flocked for this purpose. A thread applied to the thread lay-on surface is held on it by a sort of clamping effect.

The actual storage region is located at the place of the upper course of each belt 30 which, upon rotation of the rollers 31, 32 in the direction indicated by the arrow B (FIG. 4), is driven in translation in the direction of the arrow C (FIG. 5). The mounting plate 33 is arranged perpendicular to the direction of the filling thread insertion of the loom and the two courses of each belt 30 lie in planes which extend approximately parallel to the plane of the warp threads when the shed is closed. The direction of movement C of the upper course of each belt 30 thus extends in warp direction but opposite to the direction of transportation of the warp threads upon the weaving. The three pairs of rollers 31 and 32, and thus also the corresponding belts 30, are staggered vertically (distance from the bottom) and laterally (distance from the mounting plate 33) so that the storage regions of the individual belts 30 do not interfere with each other.

At the start of each storage region, i.e. immediately behind the roller 31 in the direction of the arrow C, a feed nozzle 37 which is directed perpendicular to the upper course of the belt 30 is arranged above said belt and is held by a suitable yoke-shaped carrier 38. By the rigidly arranged feed nozzles 37, filling threads $S_1$, $S_2$, $S_3$ are blown onto the belt 30 which is moved in the direction of the arrow C. As a result of the fixed position of the feed nozzles 37, thread packages $P_1$, $P_2$, $P_3$ are formed on the upper course of each belt 30, said packages spreading out towards the roller 32 and being withdrawn laterally, i.e. in filling direction, before they reach said roller. The thread packages $P_1$, $P_2$, $P_3$ consist of turns which are partially superimposed over each other, as in FIG. 2.

One difference from the storage device 18 shown in FIG. 2 resides in the position of the storage regions of the thread carriers relative to the filling-thread insertion direction. In the example of FIG. 2, the thread carrier 34 is perpendicular to the direction of insertion of the filling thread while in the example of FIGS. 4 and 5 the belts 30 are parallel to the weaving plane and therefore perpendicular to the thread carrier 34. Certain modifications result from this for the withdrawal and measuring devices 7 to 15 (FIG. 1) for the filling threads, they consisting essentially of the fact that the feed nozzles 37 (FIG. 4) are turned 90° with respect to the thread guide eyes M (FIG. 3). Thus in the example of FIGS. 4 and 5 the mounting plate 14 (FIGS. 1, 3) also is imparted a different appearance. Since these changes however are easily understood by the expert they will not be described further here.

In the region of the point of reversal of each belt 30 on the roller 32 there is arranged a blast nozzle or means 39 which, at intervals of several minutes each, blows briefly against the belt 30 and thereby cleans the latter of any dust which might have accumulated.

The storage region of each belt 30 is covered by a small plate 40 which rests "floating" from above under the action of its own weight on the belt 30. The small plate 40, which consists of a relatively light and transparent material, is in this connection fixed merely against displacement in the transverse and longitudinal directions of the belt 30. This fixing is effected by a yoke 41 which is connected to the small plate 40 and is guided in a corresponding groove of a bearing pedestal 43 fastened to a carrier 42.

As can be noted in particular from FIG. 5, in which the feed nozzle 37 has been omitted at the belt 30 which is furthest away from the mounting plate 33, the small plate 40 extends from the support 42 for the bearing pedestal 43, within support is arranged in the region of the roller 32 opposite to the direction C, up to the feed nozzle 37 and in the region of the latter has an opening 44 through which the filling thread is blown onto the belt 30. In order that the air blown against the belt 30 can escape, the opening 44 is extended towards the one side edge of the small plate 40. Of course, the plate 40 could also be made smaller so that it does not extend entirely up to the feed nozzle 37. In this way the opening 44 could be dispensed with. The thread package $P_1$, $P_2$, $P_3$ moves, immediately after the formation of the first turns, below the small plate 40 and is thus fixed in position and protected from external influences, during the entire building up and withdrawal thereof. In particular, the individual turns cannot entangle with each other and the thread packages remain fixed, even when the loom is stopped.

The storage device of the invention has been shown in the drawings in combination with a triple mixer. Of course, the storage device is not limited to this use but can be employed also with other mixers or with insertion of filling thread which is withdrawn from only one storage bobbin.

Although the invention is described in detail for the purpose of illustration, it is to be understood that such detail is solely for that purpose and that variations can be made therein by those skilled in the art without departing from the spirit and scope of the invention except as it may be limited by the claims.

What is claimed is:

1. A device for storing filamentary thread material for inserting weft threads in weaving machines, having a feed nozzle for feeding the thread material and air, and further having an endless thread carrier provided with a rough surface and passing the said nozzle for temporary retaining of the fed material, characterized by the fact that the feed nozzle is arranged rigidly fixed in position, and that a cover member is arranged about the horizontal part of the thread carrier, which cover member rests on the thread carrier merely under the action of its own weight and is fixed against displacement in the longitudinal and transverse directions of the thread carrier, wherein the material coming from the nozzle is introduced between thread carrier and cover member.

2. The device according to claim 1 in which the thread carrier is covered by a cover member at the point of the formation of thread packages from said thread material and the depositing of the thread packages is effected into the space between thread carrier and cover member.

3. The device according to claim 2 in which the thread carrier is formed by an endless belt which has an adherent covering on its outer side and is conducted over two rollers and the cover member is formed by a small plate which extends between the rollers.

4. The device according to claim 3 in which the small plate rests on the belt merely under the action of its own weight and is fixed against displacement in the longitudinal and transverse directions of the belt.

5. The device according to claim 4 in which the small plate is fixed in the region of its end further from the feed nozzle and its free end extends up to below the feed nozzle and, in the region of the jet outlet opening of the latter, has an opening which permits the application of the threads onto the belt, the said opening being towards a side edge of the small plate.

6. The device according to claim 3 in which a cleaning means is provided for the endless belt and said means is preferably formed by suction means.

7. The device according to claim 2 operatively associated on a loom to which filling threads withdrawn from a plurality of stored bobbins are fed and into which the different filling threads are alternately inserted, the alternation of the different filling threads taking place in a constant rhythm and in each case one filling thread from one supply bobbin following one from another supply bobbin, and in which a separate feed nozzle is provided for each of the filling threads, characterized by the fact that the thread carrier is so arranged that the filling threads are withdrawn laterally from each thread package, respectively.

8. The device according to claim 7 in which the surface of the thread carrier which holds the thread packages is arranged approximately parallel to the plane of the warp threads when the shed of the loom is closed.

9. The device according to claim 8 in which for each of the filling threads a separate thread carrier is provided and the individual thread carriers are arranged staggered with respect to each other in the lateral distance from the shed of the loom and in height.

10. The device according to claim 9 in which each feed nozzle is directed from above towards its associated thread carrier and the direction of movement of the part of each thread carrier which faces the feed nozzle lies in the direction of the warp-threads in the loom but opposite to their direction of transport in the weaving process.

11. The device according to claim 1 operatively associated on a loom in which are fed filling threads drawn from a plurality of supply bobbins and into which the different filling threads are alternately inserted during the operation of the loom, the alternation of the different filling threads taking place in a constant rhythm and in each case one filling thread from one supply bobbin following one from another supply bobbin, characterized by the fact that a separate feed nozzle is provided for each of the filling threads and that a common drive means is provided for the thread carriers which are associated with the feed nozzles.

12. The device according to claim 11 in which a single common thread carrier is provided which has a lay-on track for each thread package.

* * * * *